US005429657A

United States Patent [19]

Glicksman et al.

[11] Patent Number: 5,429,657

[45] Date of Patent: Jul. 4, 1995

[54] METHOD FOR MAKING SILVER-PALLADIUM ALLOY POWDERS BY AEROSOL DECOMPOSITION

[75] Inventors: Howard D. Glicksman, Wilmington, Del.; Toivo T. Kodas, Albuquerque, N. Mex.; Tammy C. Pluym, St. Clair, Minn.

[73] Assignee: E. I. Du Pont de Nemours and Company, Wilmington, Del.

[21] Appl. No.: 177,831

[22] Filed: Jan. 5, 1994

[51] Int. Cl.[6] ..... B22F 9/24

[52] U.S. Cl. ..... 75/351; 75/370; 75/371

[58] Field of Search ..... 75/351, 362, 370, 371

[56] References Cited

U.S. PATENT DOCUMENTS

| | | | |
|---|---|---|---|
| 4,023,961 | 5/1977 | Douglas et al. | 75/.5 AC |
| 4,396,420 | 8/1983 | Schmidberger et al. | 75/0.5 AC |
| 4,994,107 | 2/1991 | Flagan et al. | 75/367 |
| 5,250,101 | 10/1993 | Hidaka et al. | 75/362 |
| 5,292,359 | 3/1994 | Jeng-Shyong et al. | 75/351 |

FOREIGN PATENT DOCUMENTS

| | | |
|---|---|---|
| 0249366 | 5/1987 | European Pat. Off. . |
| 60139903 | 6/1985 | Japan . |
| 60139904 | 6/1985 | Japan . |

OTHER PUBLICATIONS

Chemical Abstracts, vol. 118, No. 18, May 3, 1993, Masuyuki K. "Manufacture of fine-grained palladium powders" p. 169, Column 1, Abstract No. 171 954y and Japan Kokai Tokkyo Koho JP 04,333,503.

Chemical Abstracts, vol. 118, No. 18, May 3, 1993, Yasuo I. et al., "Palladium powder for electronics application" p. 248, column 2, Abstract No. 172 979x & Japan Kokai Tokkyo Koho JP 05 01,301.

Nagashima et al., "Preparation of Fine Metal Particles from Aqeous Solutions of Metal Nitrate by Chemical Flame Method" Dec. 1987.

Chemical Abstracts, vol. 113, No. 26, Dec. 24, 1990, L. S. Radkevich et al., "Preparation of silver powder from organometallic compound", p. 274, column 2.

Chemical Abstracts, vol. 108, No. 24, Jun. 13, 1988, S. M. Ryabykh et al., "Formation and properties of ultrafine metal particles during decomposition of heavy metal azides", p. 257, column 2.

Chemical Abstracts, vol. 71, No. 4, Jul. 28, 1969, A. G. Sutugin et al., "Preparation of finely divided powders via the aerosol state", p. 110, column 1.

Kato, et al., "Preparation of Silver Particles by Spray-Pyrolysis Technique" Dec. 1985.

*Primary Examiner*—Scott Kastler

[57] ABSTRACT

A method for the manufacture of fully densified, finely divided particles of silver-palladium alloy comprising the sequential steps:

A. Forming an unsaturated solution of a mixture of thermally decomposable silver-containing compound and a thermally decomposable palladium-containing compound in a thermally volatilizable solvent;

B. Forming an aerosol consisting essentially of finely divided droplets of the solution from step A dispersed in a carrier gas, the droplet concentration which is below the concentration where collisions and subsequent coalescence of the droplets results in a 10% reduction in droplet concentration;

C. Heating the aerosol to an operating temperature above the decomposition temperature of both the silver-containing compound and the palladium-containing compound but below the melting point of a silver-palladium alloy by which (1) the solvent is volatilized, (2) the silver-containing compound and the palladium-containing compound are decomposed to form finely divided particles of silver, palladium, silver-palladium alloy, or mixtures thereof, and (3) the particles form an alloy and are densified; and D. Separating the particles of silver-palladium alloy from the carrier gas, reaction by-products and solvent volatilization products.

6 Claims, 6 Drawing Sheets

METHOD FOR MAKING SILVER-PALLADIUM ALLOY POWDERS BY AEROSOL DECOMPOSITION

FIELD OF INVENTION

The invention is directed to an improved process for making silver-palladium alloy powders. In particular, the invention is directed to a process for making such powders that are fully dense with high purity and with spherical morphology.

BACKGROUND OF THE INVENTION

Metal and metal alloy powders have many important applications, especially in electronics and dental industries. Mixtures of palladium and silver are widely used in conductor compositions for hybrid integrated circuits. They are less expensive than gold compositions, are compatible with most dielectric and resistor systems, and are suitable for ultrasonic wire bonding. The addition of palladium to silver greatly enhances the compatibility of the circuit for soldering, raises the melting point of the silver for compatibility with the dielectric firing temperatures and reduces the problems of silver migration which can cause degradation of the dielectric properties and shorting.

Silver powder, palladium powder, mixtures of silver and palladium powder, and silver-palladium alloy powders are used in electrode materials for multilayer ceramic capacitors. The properties of the metallic components of thick film inks intended for the internal electrodes of multilayer ceramic capacitors are extremely important because compatibility is required between the metal powder and the organic medium of an ink and between the ink itself and the surrounding dielectric material. Metal particles that are uniformly sized, approximately 0.1–1.0 microns in diameter, pure, crystalline, and unagglomerated are required to maximize the desired qualities of a conductive thick film paste.

Printed circuit technology is requiring denser and more precise electronic circuits. To meet these requirements, the conductive lines have become more narrow in width with smaller distances between lines. This is especially true where multilayer ceramic capacitors are requiring thinner and narrower electrodes. The metal particles necessary to form dense, closely packed, narrow lines must be as close as possible to monosized, fully dense, smooth spheres. The conductive metal particles must have a small particle diameter, an even grain size and a uniform composition. In general, mixtures of silver and palladium powders are used to form the correct ratio silver-palladium powder. After the conductor lines are printed and fired, the silver and palladium particles are alloyed. As the printed lines get smaller, the requirements for homogeneity become much more important. To insure homogeneity of the alloy, it is preferred to start with a fully dense silver-palladium alloy powder at the desired ratio.

Many methods currently used to manufacture metal powders can be applied to the production of silver-palladium powders. For example chemical reduction methods, physical processes such as atomization or milling, thermal decomposition, and electrochemical processes can be used. Silver powders and palladium powders used in electronic applications are generally manufactured using chemical precipitation processes. In making a silver powder and/or a palladium powder, a metal salt is reduced by using reducing agents such as hydrazine, formaldehyde, hypophosphorous acid, hydroquinone, sodium borohydride, formic acid, and sodium formate. These processes tend to be very hard to control and give irregular shaped particles that are agglomerated.

To obtain the desired silver/palladium ratio, the individual powders are mixed during the manufacture of the thick film paste. In some cases, co-precipitation is used, but the resulting powders are normally just mixtures of silver particles and palladium particles. The present invention uses aerosol decomposition for the production of a silver-palladium alloy.

The aerosol decomposition process involves the conversion of a precursor solution to a powder. The process involves the generation of droplets, transport of the droplets with a gas into a heated reactor, the removal of the solvent by evaporation, the decomposition of the salt to form a porous solid particle, and then the densification of the particle to give fully dense, spherical pure particles. Conditions are such that there is no droplet-to-droplet or particle-to-particle interaction.

The major problem that has limited successful application of the aerosol decomposition process for powder generation is lack of control over particle morphology. In particular, it was the requirement that the material must be treated above its melting point to form fully dense particles and that operating below the melting point tended to give impure, hollow-type particles which were not densified.

SUMMARY OF THE INVENTION

The invention is, therefore, directed to a method for the manufacture of fully densified, finely divided particles of silver-palladium alloy comprising the sequential steps:

A. Forming an unsaturated solution of a mixture of thermally decomposable silver-containing compound and a thermally decomposable palladium-containing compound in a thermally volatilizable solvent;

B. Forming an aerosol consisting essentially of finely divided droplets of the solution from step A dispersed in a carrier gas, the droplet concentration which is below the concentration where collisions and subsequent coalescence of the droplets results in a 10% reduction in droplet concentration;

C. Heating the aerosol to an operating temperature above the decomposition temperature of both the silver-containing compound and the palladium-containing compound but below the melting point of a silver-palladium alloy by which (1) the solvent is volatilized, (2) the silver-containing compound and the palladium-containing compound are decomposed to form finely divided particles of silver, palladium, silver-palladium alloy, or mixtures thereof, and (3) the particles form an alloy and are densified; and D. Separating the particles of silver-palladium alloy from the carrier gas, reaction by-products and solvent volatilization products.

Definitions

Figure 1:
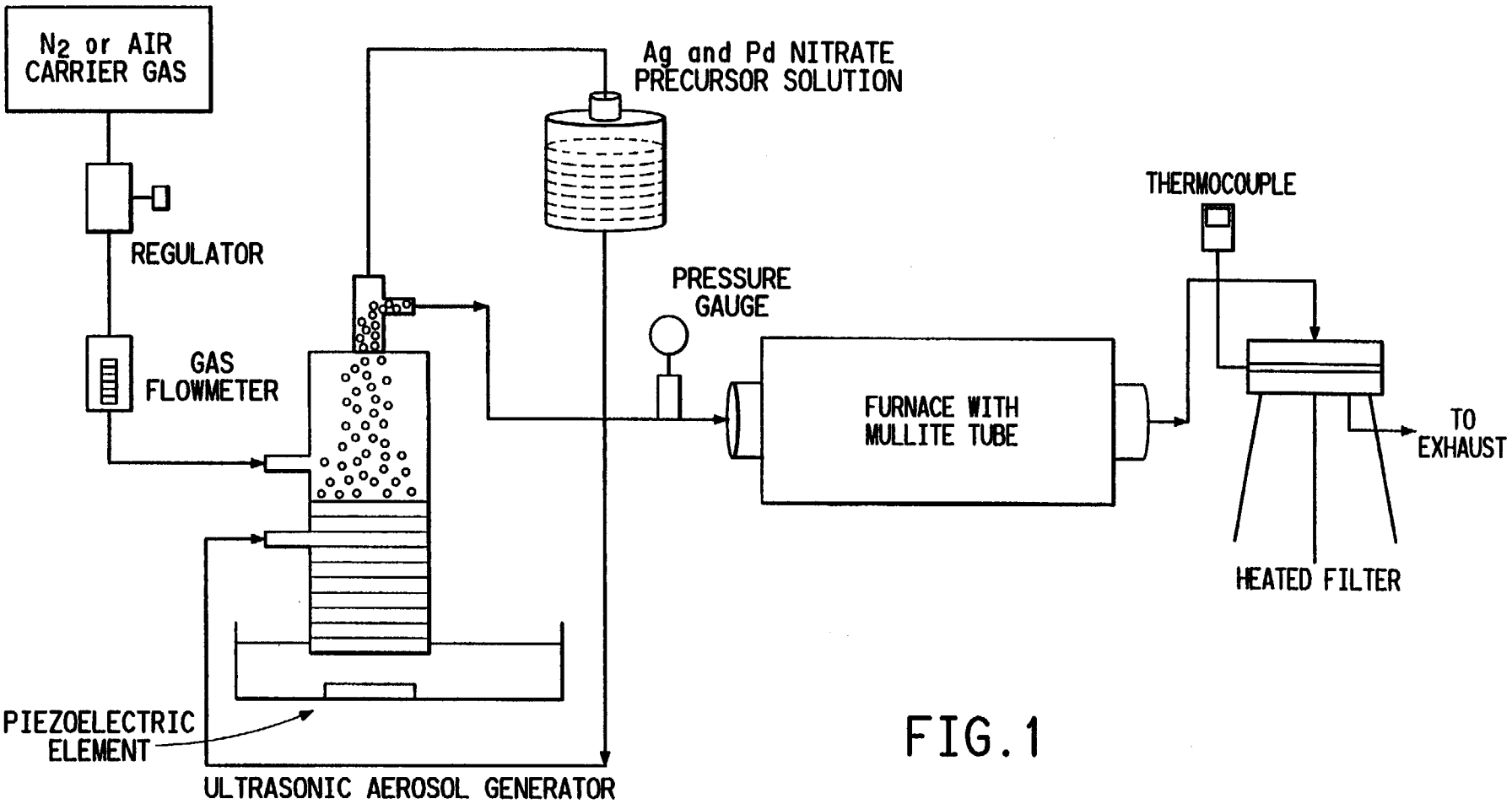
FIG. 1 is a diagram of an experimental apparatus.

As used herein with respect to the solvent for the silver-containing compound and the palladium-containing compound, the term "volatilizable" means that the solvent is completely converted to vapor or gas by the time the highest operating temperature is reached, whether by vaporization and/or by decomposition.

As used herein with respect to silver-containing compounds and palladium-containing compounds, the term "thermally decomposable" means that the compound becomes fully decomposed to the metal and volatilized by-products by the time the highest operating temperature is reached. For example, $AgNO_3$ and $Pd(NO_3)_2$ are decomposed to form $NO_x$ and Ag and Pd metal, respectively.

DETAILED DESCRIPTION OF THE INVENTION

Silver-containing compound and Palladium-containing compound: Any soluble silver salt and palladium salt can be used in the method of the invention so long as it is inert with respect to the carrier gas used to form the aerosols. Examples of suitable salts are $AgNO_3$, $Ag_3PO_4$, $Ag_2SO_4$, $Pd(NO_3)_2$, $PdSO_4$, $Pd_3(PO_4)_2$ and the like. Insoluble silver or palladium salts are not suitable. The silver-containing compound and palladium-containing compound may be used in concentrations as low as 0.002 mole/liter and upward to just below the solubility limit of the particular salt. It is preferred not to use concentrations below 0.002 mole/liter or higher than 90% of saturation.

While it is preferred to use water-soluble silver salts as the source of silver and water-soluble palladium salts as the source of palladium for the method of the invention, the method can, nevertheless, be carried out effectively with the use of other solvent-soluble compounds such as organometallic silver, palladium, or mixed silver-palladium compounds dissolved in either aqueous or organic solvents.

Operating Variables: The method of the invention can be carried out under a wide variety of operating conditions so long as the following fundamental criteria are met:

1. The concentration of the silver-containing compound and the palladium-containing compound in the aerosol must be below the saturation concentration at the feed temperature and preferably at least 10% below the saturation concentration in order to prevent precipitation of solids before removal of the liquid solvent;
2. The concentration of droplets in the aerosol must be sufficiently low so that it is below the concentration where collisions and subsequent coalescence of the droplets results in a 10% reduction in droplet concentration;
3. The temperature of the reactor is below the melting point of the formed alloy. For example, below 1170° C. the melting point for 70/30 Ag/Pd, 1335° C. the melting point for 40/60 Ag/Pd, and 1420° C. the melting point for 20/80 Ag/Pd.

Though it is essential to operate under the saturation point of the silver-containing compound and palladium-containing compound, their concentration is not otherwise critical in the operation of the process. Much lower concentrations of silver-containing and palladium-containing compounds can be used. However, it will ordinarily be preferred to use higher concentrations to maximize the mass of particles that can be made per unit of time.

Any conventional apparatus for droplet generation may be used to prepare the aerosols for the invention such as nebulizers, collision nebulizers, ultrasonic nebulizers, vibrating orifice aerosol generators, centrifugal atomizers, two-fluid atomizers, electrospray atomizers and the like. The particle size of the powder is a direct function of the droplet sizes generated. The size of the droplets in the aerosol is not critical in the practice of the method of the invention. However, as mentioned above, it is important that the number of droplets not be so great as to incur excessive coalescence which broadens the particle size distribution and increases the particle size.

In addition, for a given aerosol generator, concentration of the solution of the silver-containing compound and the palladium-containing compound has an effect on particle size. In particular, particle size is an approximate function of the cube root of the concentration. Therefore, the higher the silver-containing and palladium-containing compounds concentration, the larger the particle size of the precipitated silver. If a greater change in particle size is needed, a different aerosol generator must be used.

Virtually any vaporous material which is inert with respect to the solvent for the silver-containing and palladium-containing compounds and with respect to the compounds themselves, may be used as the carrier gas for the practice of the invention. Examples of suitable vaporous materials are air, nitrogen, oxygen, steam, argon, helium, carbon dioxide, and the like. Gases not containing oxygen, such as nitrogen are the preferred carrier gases since they allow fully densified silver-palladium alloy particles to be made at the lowest temperature and at the highest purity.

The temperature range over which the method of the invention can be carried out is quite wide and ranges from the decomposition temperature of the silver-containing compound or the palladium-containing compound whichever is greater, to the melting point of the silver-palladium alloy being formed. The greater the percentage of palladium, the greater the melting point of the silver-palladium alloy. When air is used as the carrier gas, the temperature required to produce fully densified silver-palladium alloy particles is greater than when using nitrogen gas.

This invention allows for the production of spherical fully dense silver-palladium alloy to be made at significantly lower temperatures then the respective melting points. For instance, fully dense 70/30 Ag/Pd alloy which has a melting point of 1170° C. may be made at around 700° C. Fully dense 40/60 Ag/Pd alloy which has a melting point of 1335° C. may be made at about 800° C. The reduction in temperature translates into significant energy savings in the manufacturing process for the alloy powders without sacrificing quality.

The type of apparatus used to heat the aerosol is not by itself critical and either direct or indirect heating may be used. For example, tube furnaces may be used or direct heating in combustion flames may be used.

Upon reaching the reaction temperature and after the particles are fully densified, they are separated from the carrier gas, reaction by-products and solvent volatilization products and the powder collected by one or more devices such as filters, cyclones, electrostatic separators, bag filters, filter discs, and the like. The gas upon completion of the reaction consists of the carrier gas, decomposition products of the silver containing compound and palladium containing compound, and solvent vapor. Thus, in the case of preparing silver-palladium alloy particles from aqueous silver nitrate and palladium nitrate using $N_2$ as the carrier gas, the effluent gas from the method of the invention will consist of nitrogen oxide(s), water and $N_2$.

Test Apparatus: The experimental apparatus used in this work is shown in FIG. 1. A source of carrier gas supplies either $N_2$ or air through the regulator and gas flow meter. The carrier gas flow rate determined the residence time of the aerosol in the reactor. The nitrate precursor solutions were mixtures of $AgNO_3$ and $Pd(NO_3)2$ prepared in Ag/Pd weight ratios of 95/5, 70/30, 40/60, and 20/80. The solution concentration was varied between 0.1 and 1.0 wt % Ag/Pd. The ultrasonic generator was a modified Pollenex home humidifier, which created an aerosol when a glass chamber with a plastic membrane bottom was filled with precursor solution and placed over the piezoelectric element of the humidifier. The reactor was a Lindberg 3-Zone furnace with a 91 cm. heated region. A 152.4 cm Coors mullite rector tube (9 cm O.D., 8 cm I.D.) was used. The carrier gas flow rate was adjusted for each temperature to maintain a constant reactor residence time of 9.4 seconds with the exception of Example 1 in Table 1. The particles were collected on a membrane filter supported by a heated stainless steel filter holder. The filter was a Tuffryn membrane filter (142 mm dia., 0.45 pore dia.) supported on a Gelman 147 mm dia. filter holder.

Fourteen process runs were performed in which the method of the invention was demonstrated. The operating conditions of these runs are shown in Table 1 below, along with the selected properties of the silver-palladium alloy particles produced therefrom.

TABLE 1

| | 1 | 2 | 3 | 4 | 5 | 6 | 7 |
|---|---|---|---|---|---|---|---|
| Silver (wt. %) | 70 | 70 | 70 | 70 | 70 | 70 | 70 |
| Palladium (wt. %) | 30 | 30 | 30 | 30 | 30 | 30 | 30 |
| Furnace Temperature (°C.) | 400 | 600 | 700 | 900 | 1000 | 700 | 800 |
| Carrier Gas | $N_2$ | $N_2$ | $N_2$ | $N_2$ | $N_2$ | air | air |
| Concentration (wt. %) | 1 | 1 | 1 | 1 | 1 | 1 | 1 |
| Flow Rate (l/min.) | 6.5 | 10.0 | 7.0 | 7.5 | 6.9 | 9.0 | 8.1 |
| Residence Time (sec.) | 18.7 | 9.35 | 9.35 | 9.35 | 9.35 | 9.35 | 9.35 |
| *Weight Loss at 400° C. (%) | 14 | 0 | 0 | 0 | 0 | 0.3 | 0 |
| X-Ray Diffraction | PdO, Pd $AgNo_3$ | AgPd PdO | AgPd | AgPd | AgPd | AgPd | AgPd |
| | 8 | 9 | 10 | 11 | 12 | 13 | 14 |
| Silver (wt. %) | 40 | 40 | 40 | 20 | 20 | 20 | 95 |
| Palladium (wt. %) | 60 | 60 | 60 | 80 | 80 | 80 | 5 |
| Furnace Temperature (°C.) | 600 | 700 | 800 | 600 | 700 | 800 | 600 |
| Carrier Gas | $N_2$ | $N_2$ | $N_2$ | $N_2$ | $N_2$ | $N_2$ | $N_2$ |
| Concentration (wt. %) | 0.5 | 1 | 0.5 | 0.1 | 1.0 | 0.1 | 1 |
| Flow Rate (l/min.) | 10.0 | 9.0 | 8.1 | 10.0 | 9.0 | 8.1 | 10.0 |
| Residence Time (sec.) | 9.35 | 9.35 | 9.35 | 9.35 | 9.35 | 9.35 | 9.35 |
| *Weight Loss at 400° C. (%) | 0 | 0 | 0 | 1.5 | 0 | 0 | 0 |
| X-Ray Diffraction | PdO Ag | AgPd PdO | AgPd | PdO Ag | AgPd PdO | AgPd | AgPD |

*Determined by Thermogravimetric analysis

To provide examples of the invention, silver-palladium alloy particles were prepared at silver/palladium ratios of 70/30, 40/60, 20/80, and 95/5.

Figure 2:
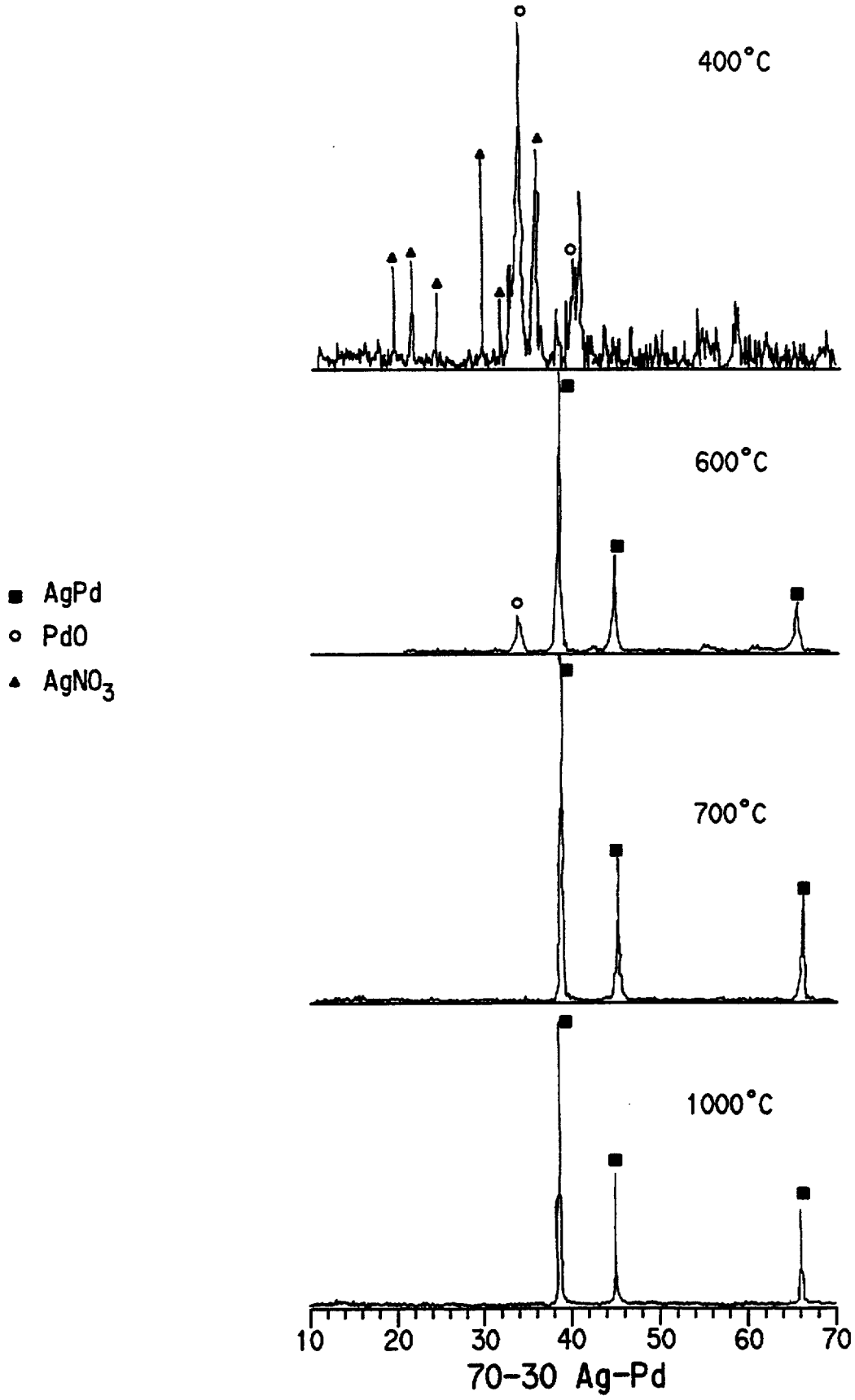
FIG. 2 is x-ray diffraction patterns of Examples 1–5.

Examples 1-5 indicate pure silver-palladium alloy powder in a 70/30 ratio was made at temperatures above 600° C. using $N_2$ as the carrier gas. X-ray diffraction presented in FIG. 2, shows that the PdO still is present at 600° C., whereas, fully dense Ag/Pd alloy powder is made at 700° C. In addition, the $2\theta$ for the most intense peak was located between the expected values for Ag and Pd indicative of the Ag/Pd alloy.

Examples 6 and 7 were made in a 70/30 Ag/Pd ratio using air as the carrier gas. Unlike with $N_2$ gas, the 700° C. run had a small amount of impurities shown by the weight loss. This means that a higher temperature is needed to produce similar powder using air as the carrier gas.

Figure 3:
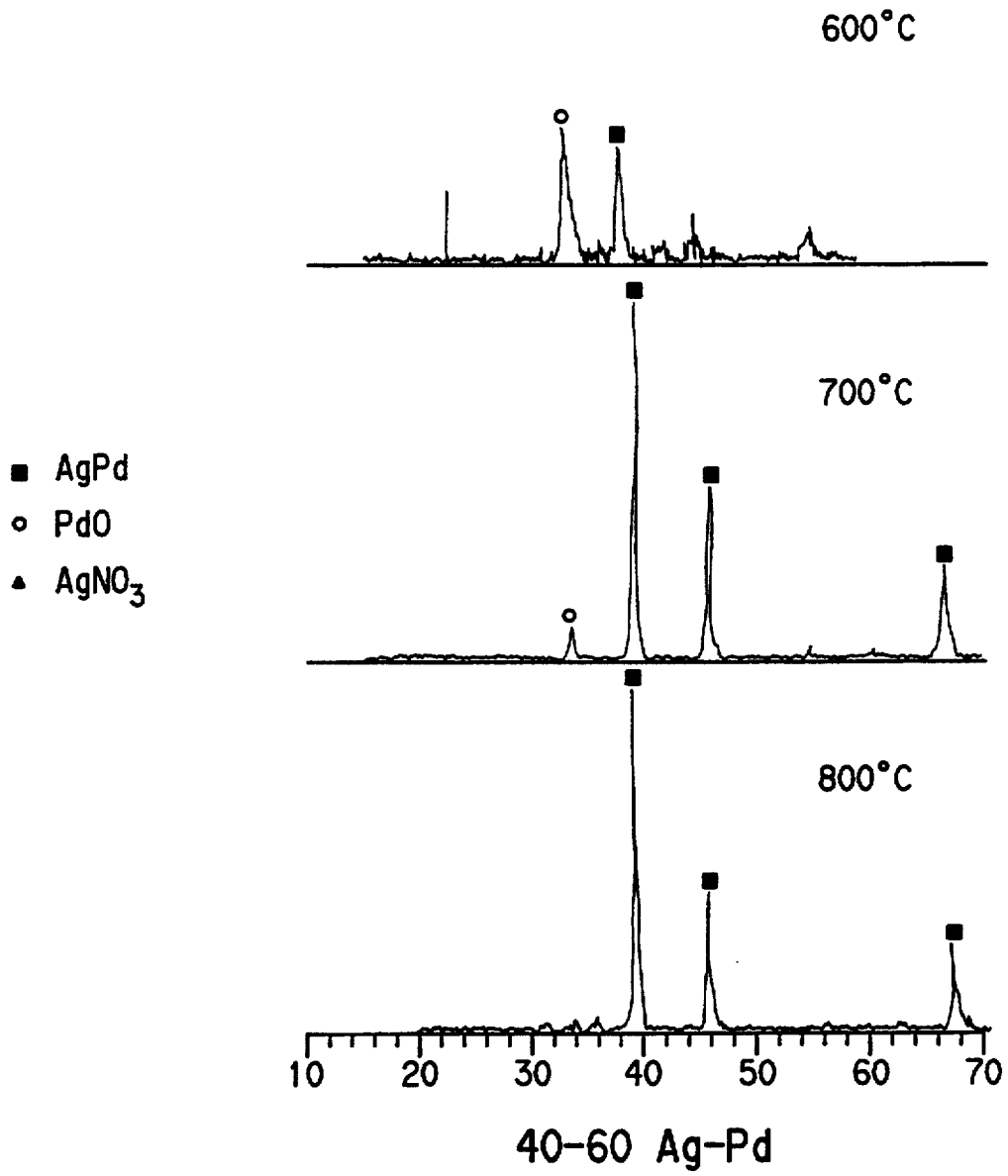
FIG. 3 is x-ray diffraction patterns of Examples 8–10.

Examples 8-10 indicate pure silver-palladium alloy powder in a 40/60 ratio was made at temperatures above 700° C. The x-ray diffraction pattern shown in FIG. 3 indicates that a small amount of PdO is still present at 700° C.

Figure 4:
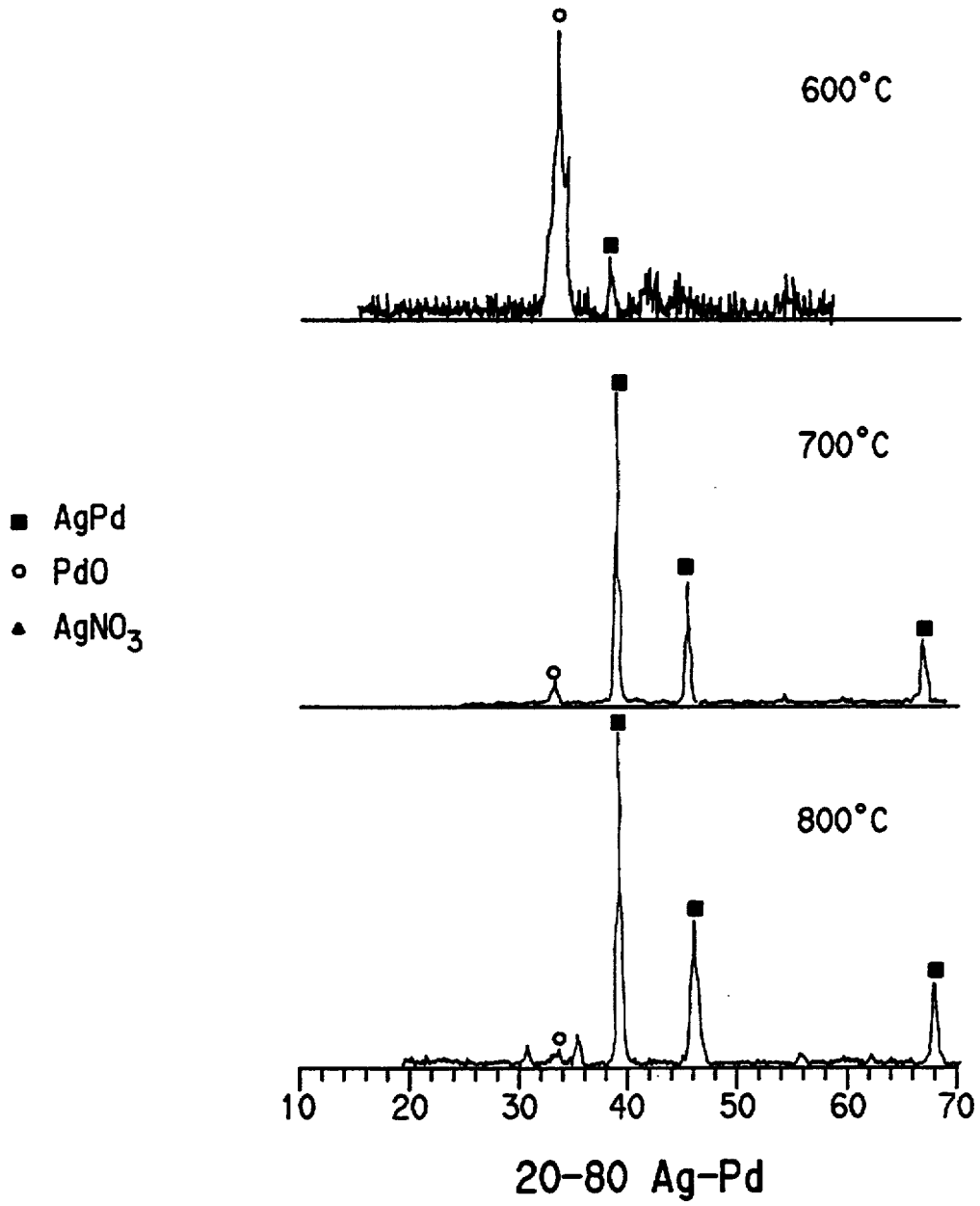
FIG. 4 is x-ray diffraction patterns of Examples 11–13.

Examples 11-13 indicate pure silver-palladium alloy powder in a 20/80 ratio was made at temperatures above 800° C. The 600° C. run had a small amount of weight loss and the 800° C. examples still showed a small amount of PdO present in the x-ray diffraction pattern shown in FIG. 4.

Figure 5:
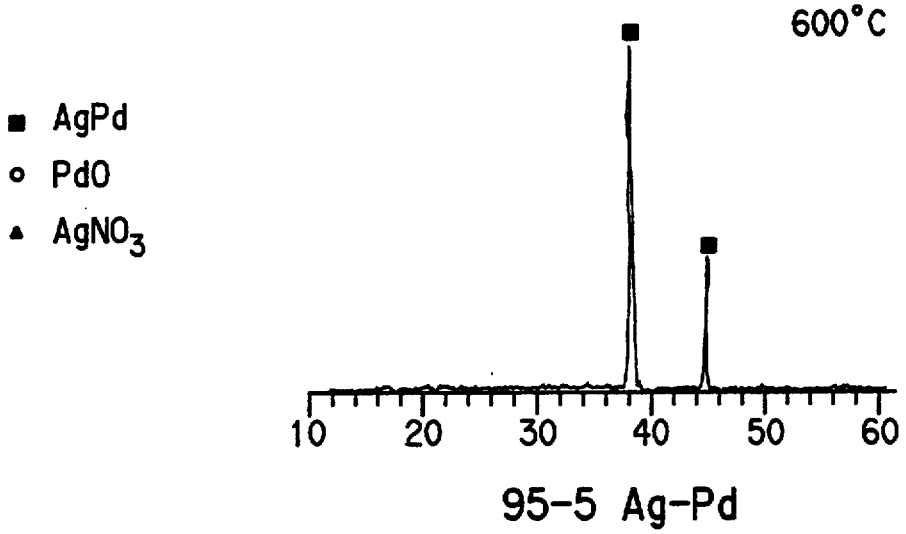
FIG. 5 is an x-ray diffraction pattern of Example 14.

Example 14 demonstrates that at very high silver to palladium ratios such as 95/5, pure, dense, silver-palladium alloy particles are made at temperatures as low as 600° C. when using $N_2$ as a carrier gas. The x-ray diffraction pattern is shown in FIG. 5.

Examination by scanning electron microscopy (SEM) and transmission electron microscopy (TEM) of the particulate products produced in accordance with the invention (examples 3-5, 7, 11, 13, and 14) showed that the particles were both dense and spherical.

Silver-palladium alloy powders made by the aerosol decomposition method of the invention are pure, dense, unagglomerated, spherical, and have a controlled size dependent on the aerosol generator and the concentration of the metal salt solution. Silver-palladium alloy powders made by the invention do not have the impurities, irregular shape, agglomeration, nor non-alloyed mixtures commonly found in silver-palladium powder produced by solution precipitation. Furthermore, fully reacted and densified silver-palladium alloy powders were produced at temperatures significantly below the melting point of the particular alloy.

Figure 6:
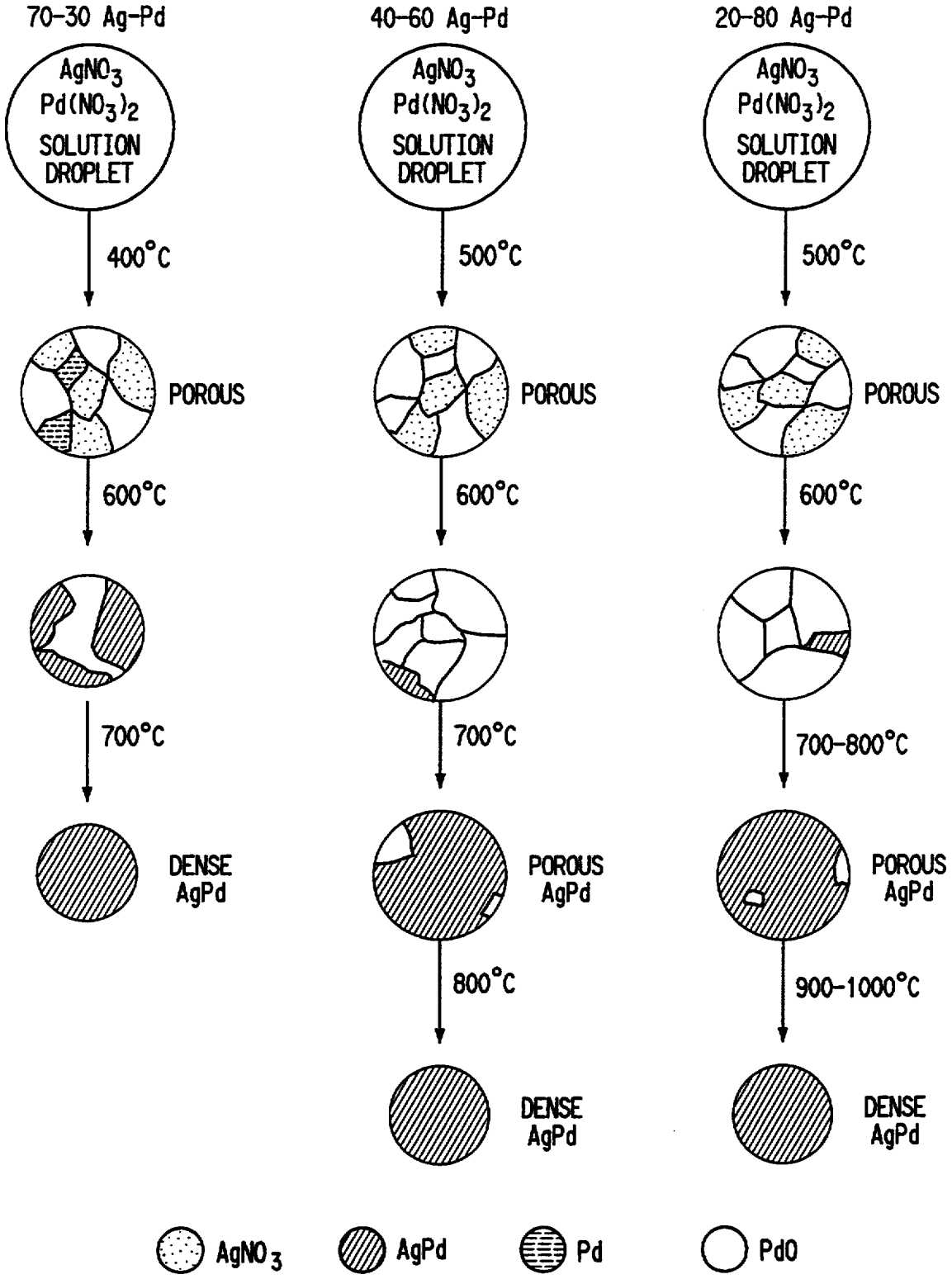
FIG. 6 is a diagram of the formation of silver-palladium alloy particles when the reaction system is based on aqueous $AgNO_3$ and $Pd(NO_3)_2$ and the carrier gas is nitrogen.

From experience with the method of the invention, it is believed that the silver-palladium alloy particles are formed in accordance with the following sequence when the reaction system is based on aqueous $AgNO_3$ and $Pd(NO_3)_2$ and the carrier gas is nitrogen:

(1) As the aerosol is heated above the evaporation temperature of the solvent, the solvent is evaporated from the aerosol droplets, thus forming porous particles containing both $AgNO_3$ and $Pd(NO_3)_2$;

(2) As the particles are heated further, the $AgNO_3$ decomposes to form porous Ag and the $Pd(NO_3)_2$ decomposes to form porous PdO particles;

(3) Continuing to increase the temperature, the PdO particles decompose to form Pd particles which then react with the Ag particles to form an alloy;

(4) During the remainder of the residence time within the reactor furnace, the porous silver-palladium alloy particles become fully densified and crystalline. A summary of this reaction scheme is shown in FIG. 6.

What is claimed is:

1. A method for the manufacture of fully densified, finely divided particles of silver-palladium alloy comprising the sequential steps:

A. Forming an unsaturated solution of a mixture of thermally decomposable silver-containing compound and a thermally decomposable palladium-containing compound in a thermally volatilizable solvent;

B. Forming an aerosol consisting essentially of finely divided droplets of the solution from step A dispersed in a carrier gas, the droplet concentration which is below the concentration where collisions and subsequent coalescence of the droplets results in a 10% reduction in droplet concentration;

C. Heating the aerosol to an operating temperature above the decomposition temperature of both the silver-containing compound and the palladium-containing compound but below the melting point of a silver-palladium alloy by which (1) the solvent is volatilized, (2) the silver-containing compound and the palladium-containing compound are decomposed to form finely divided particles of silver, palladium, silver-palladium alloy, or mixtures thereof, and (3) the particles form an alloy and are densified; and D. Separating the particles of silver-palladium alloy from the carrier gas, reaction by-products and solvent volatilization products.

2. The method of claim 1 in which the alloy contains greater than or equal to 50% silver and less than or equal to 50% palladium, the carrier gas is nitrogen, and the temperature is 600°–900° C.

3. The method of claim 1 in which the alloy contains greater than 50% palladium and less than 50% silver, the carrier gas is nitrogen, and the temperature is 800°–1000° C.

4. The method of claim 1 in which the silver-containing compound is silver nitrate and the palladium-containing compound is palladium nitrate.

5. The method of claim 1 in which the thermally volatilizable solvent is deionized water.

6. The method of claim 1 in which the carrier gas is air.

* * * * *